United States Patent [19]

Enison

[11] Patent Number: 4,698,117

[45] Date of Patent: Oct. 6, 1987

[54] INSTALLMENT SYSTEM FOR TABLE SKIRTING

[75] Inventor: Brent M. Enison, Tappan, N.Y.

[73] Assignee: Prestige Skirting and Tablecloths Inc., Orangeburg, N.Y.

[21] Appl. No.: 831,830

[22] Filed: Feb. 24, 1986

[51] Int. Cl.[4] ..... A47F 7/16; A47H 7/00; B44C 7/00; E05D 15/06

[52] U.S. Cl. ..... 156/486; 156/577; 160/194; 160/350; 211/47; 211/172

[58] Field of Search ..... 156/475, 468, 486, 492, 156/574, 577, 576, 443, 538; 211/113, 115, 119, 116, 119.03, 47, 172; 160/135, 151, 330, 350, 351, 194, 198; 4/610, 11, 594, 630; 428/41, 83, 40, 121, 122; 223/85, 87; 40/11, 594, 630, 539

[56] References Cited

U.S. PATENT DOCUMENTS

| | | | |
|---|---|---|---|
| 178,613 | 6/1876 | Elbert | 428/122 |
| 784,985 | 3/1905 | Caswell | 156/577 |
| 2,143,075 | 1/1939 | Klau | 428/122 |
| 2,904,917 | 9/1959 | Sidorou et al. | 428/40 |
| 3,411,735 | 11/1968 | Hurd | 211/113 |
| 3,885,768 | 5/1975 | Frue | 40/594 |
| 3,984,002 | 10/1976 | Howard | 223/87 |
| 3,997,091 | 12/1976 | Burnette | 223/87 |
| 4,102,513 | 7/1978 | Guard | 156/577 |
| 4,139,101 | 2/1979 | Towfigh | 160/350 |
| 4,174,246 | 11/1979 | Ralston | 156/486 |
| 4,222,187 | 9/1980 | Huck | 40/439 |
| 4,536,247 | 8/1985 | Buchholz et al. | 156/486 |
| 4,580,705 | 4/1986 | Wolfson et al. | 223/84 |

FOREIGN PATENT DOCUMENTS

| | | | |
|---|---|---|---|
| 1223476 | 6/1960 | France | 160/350 |

*Primary Examiner*—Donald E. Czaja
*Assistant Examiner*—Louis Falasco
*Attorney, Agent, or Firm*—Lilling & Greenspan

[57] ABSTRACT

An apparatus for installing table skirts to the perimeter of a banquet table having a fastener with an adhesive pile material substantially similar to an adhesive pile material on a top underside of the table skirt. The table skirt is wound in an upward direction on a hanging device having strips of adhesive pile material substantially similar to both the adhesive pile material of the fastener and of the table skirt. Once the table skirt is hung on the hanging device, the device is placed on a swivel hook attached to a rod mounted on a moveable rack in a manner so that the hook turns as the table skirt is unwound from the hanging device and the adhesive pile material of the table skirt and fasteners are pressed together as an installer moves around the perimeter of the table. To disassemble the table skirt from the table, the procedure is reversed by choosing a free end of the table skirt and pulling it apart from the adhesive material of the fastener and attaching it to the hanging device.

5 Claims, 11 Drawing Figures

FIG.1
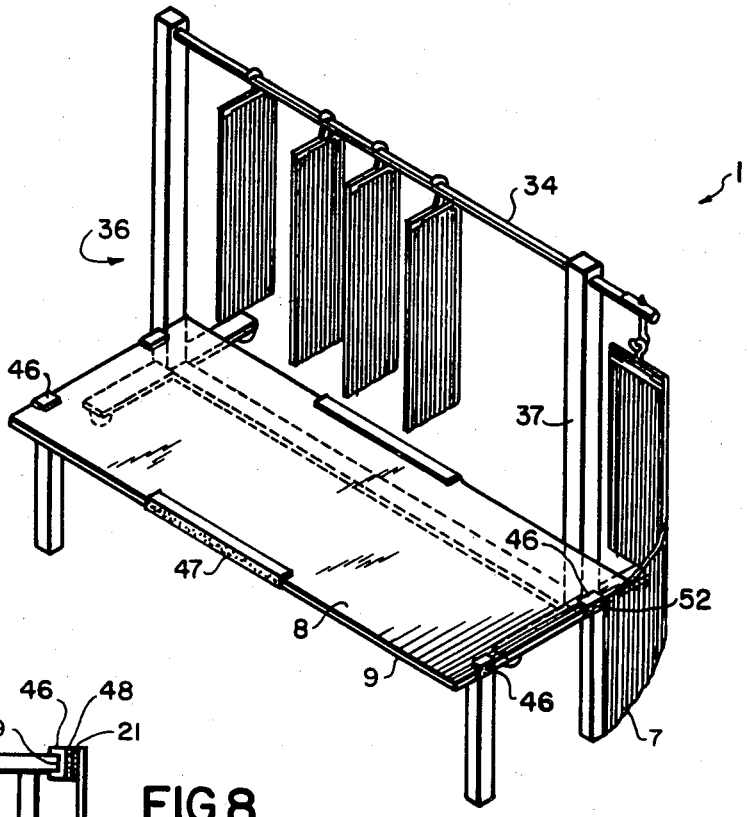
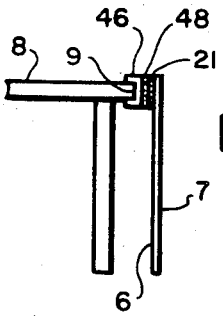
FIG.8
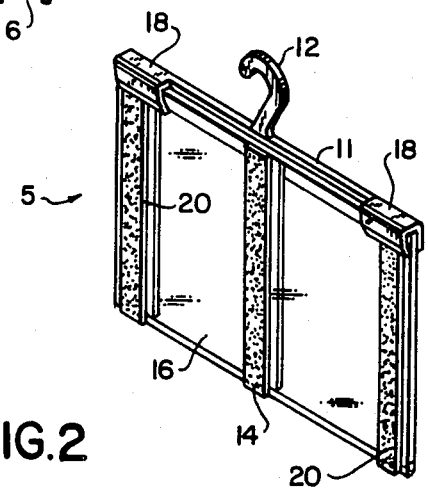
FIG.2
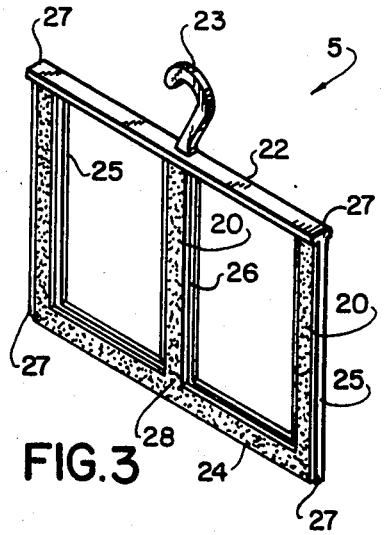
FIG.3

FIG. 4
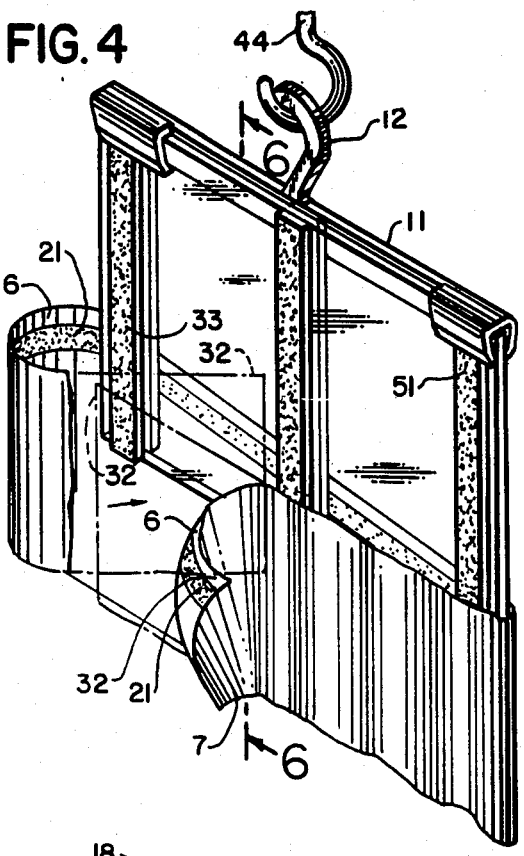
FIG.5
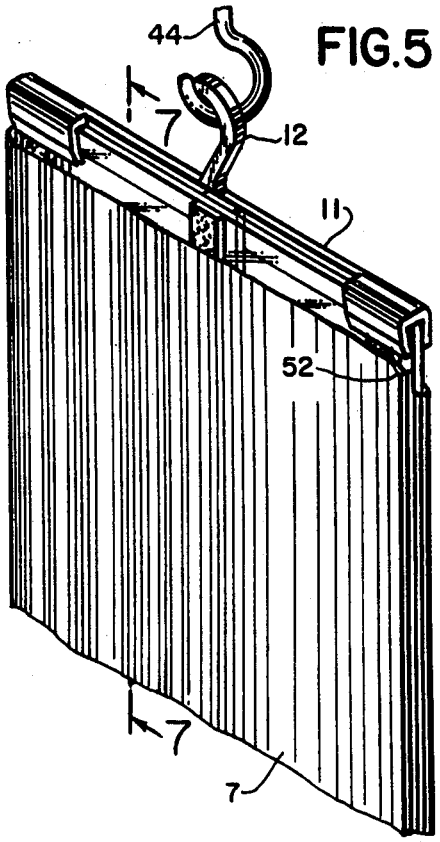
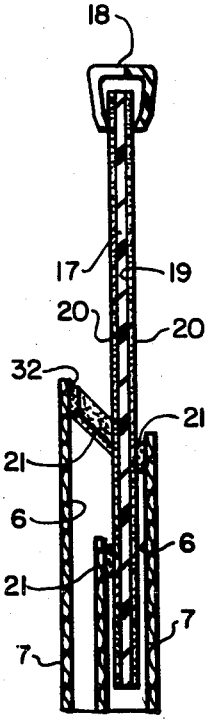
FIG.6
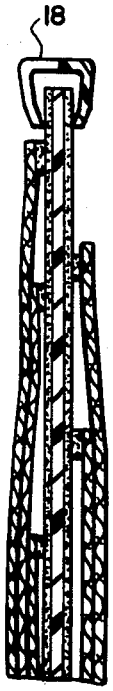
FIG.7

INSTALLMENT SYSTEM FOR TABLE SKIRTING

FIELD OF THE INVENTION

The invention is a system for easily affixing table skirts to banquet and dining tables.

BACKGROUND OF THE INVENTION

Persons involved in setting up a large number of tables such as, for example, convention meetings or banquets have historically struggled with the installation of the table skirts around the tables' edges. Prior to the invention, installers accomplished this task by clipping a U-shaped spring formed fastener having an adhesive pile material strip that can be easily pressed together or pulled apart from a similar adhesive pile material strip, such as the material marketed under the trademark VELCRO and owned by Velcro U.S.A, Inc., attached to the underside of the table skirt to be installed around the table. Although this means allows for easy attachment of the table skirt to the table to be covered, it does not solve the problem of easily manipulating the bulk of rolled cloth as the installer encircles the table. Moreover, since many table skirts are made of a slippery material such as chintz, cotton, cotton blends or polyester, it is difficult to manuever the materials without dragging them across the floor, cutting down on installment time and unnecessarily soiling the cloth leading to additional laundry expenses and shortening the lifetime of the skirts. Thus, the object of the inventive system is to decrease installment time and improve the efficiency of persons preparing to serve large numbers of people or display large numbers of things on banquet tables.

SUMMARY OF THE INVENTION

The inventive installment system consists of a moveable rack, a hanger having strips of adhesive pile material used to hold table skirts in a wrapped position around the hanger and a spring form fastener having adhesive pile strip for holding the table skirts to the tables' edges. The wrapped table skirts are hung on a rod attached to the rack and having a movable means. Further, the rod has an extension member with a swivel hook used to hold the wrapped hanger device while the skirts are being installed around the tables. The clip-on fastener is fastened onto the table to be skirted and used to attach the skirt around the circumference of the table as it is unrolled from the wrapped hanger device. Thus, an operator attaches a table skirt to the fastener attached to the table's edge as he unwinds the table skirt from the hanger device and moves about the table while pulling the moveable rack holding the hanging device with him.

BRIEF DESCRIPTION OF THE DRAWINGS

FIG. 1 is a perspective view of the inventive system illustrating the initial installment of a table skirt to a table.

FIG. 2 is a perspective view of a first embodiment of the hanger device.

FIG. 3 is a perspective view of a second embodiment of the hanger device.

FIG. 4 is a perspective view of the hanger device illustrating the initial position of the table skirt as it is wound around the hanger device.

FIG. 5 is a perspective view of the hanger device at the completion of the wrapping of the table skirt about it.

FIG. 6 is a cross sectional view taken along lines 6—6 of FIG. 4.

FIG. 7 is a cross sectional view taken along lines 7—7 of FIG. 5.

FIG. 8 is a cross sectional view taken along lines 8—8 of FIG. 1.

DETAILED DESCRIPTION OF THE INVENTION

Figure 9:
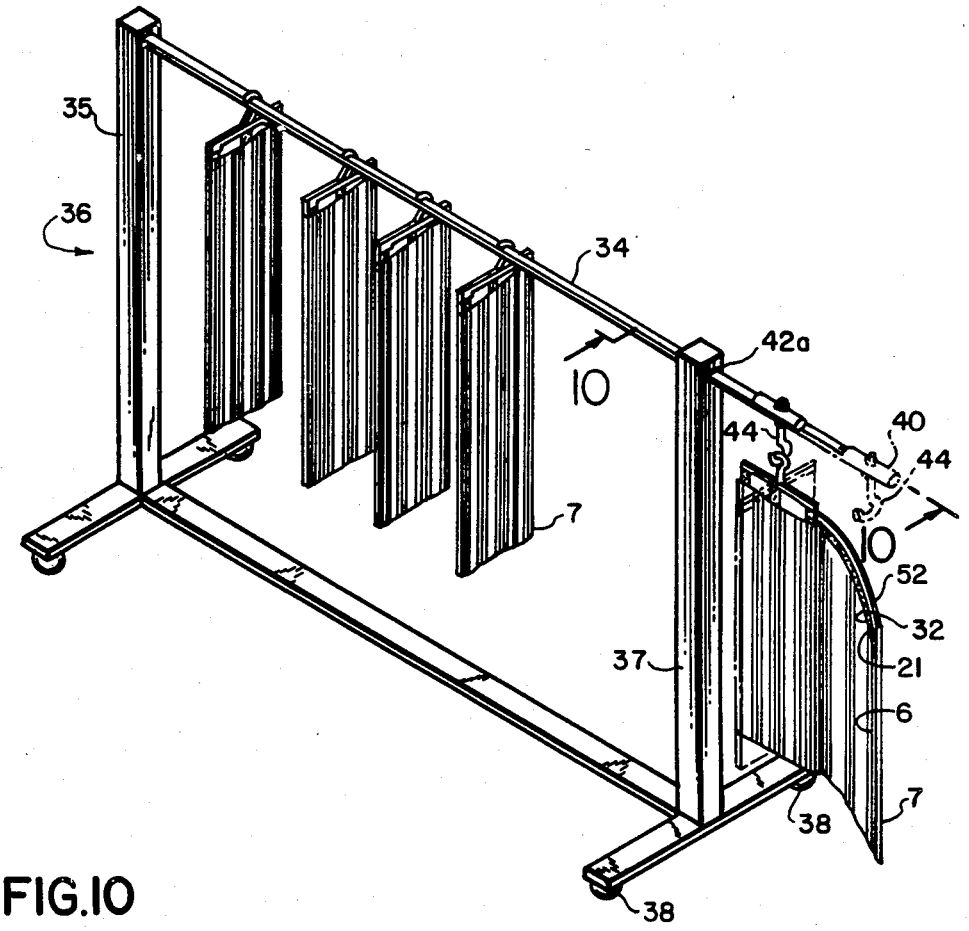
FIG. 9 is a perspective view of the hanger rack illustrating the extension member in an operating mode with the extension projection shown in phantom lines and the hanger device is illustrated in a swivel position.

As illustrated in FIGS. 1 and 9, the table skirt installment system 1 consists of a hanger device 5 used for systematically wrapping table skirts 7 which are subsequently stored on a moveable rack 36. When the table skirts 7 are attached to a table 8, they are unwound from the hanger device 5 and attached to clip-on fasteners 46 previously attached to a table's edge or perimeter 9.

The preferred embodiment of the hanger device 5 is illustrated in FIG. 2 and consists of a straight member 11 having a hook 12 positioned substantially on a top side at a center axis 14 of the device 5. The straight portion 11 and hook 12 are attached to a sheet 16 of thermoplastic material by any fastening means known in the art. Preferably, the thermoplastic sheet 16 is a material marketed under the tradmark PLEXIGLAS owned by Rohm and Haas Company of Philadelphia, Pa.; however, any similar material known in the art may be used. Further, the plastic sheet 16 is preferably clipped to the straight member 11 by a clip fastener 18 illustrated in FIGS. 4–7.

Vertically arranged on the thermoplastic sheet 16 are adhesive pile material strips 20 as illustrated in FIG. 2. A strip 20 of adhesive pile material is attached to both sides 17, 19 of the thermoplastic sheet 16 in a manner substantially parallel to the center axis 14 of the sheet 16. Although any adhesive strip material which presses together and pulls apart from itself repeatedly may be used to form the adhesive strips 20, the preferred material is marketed under the trademark VELCRO owned by Velcro USA, Inc. of Manchester, N.H.

Additionally, a third strip of adhesive pile material 20 is attached at a substantially equidistant position from the two side strips 20 near the center axis 14 of the sheet 16. As may be appreciated, the strips of adhesive pile material 20 may be arranged in any manner known in the art, however, the described arrangement distributes the weight of the table skirt 7 to be wrapped around the hanger device 5 and promotes ease in wrapping and hanging the table skirt 7. It may further be appreciated that the hanger device 5 may be molded as a single unit consisting of the thermoplastic sheet 16, a straight portion 11 and a central hook 12. In the preferred embodiment, the thermoplastic sheet 16 is transparent.

Another embodiment of the hanger device 5 is illustrated in FIG. 3 and consists of a straight portion 22 with a central hook 23 attached to a base member 24 by means of vertical ribs 25, preferably made of a plastic material. In the preferred embodiment, two ribs 25 connect ends 27 of the straight portion 22 and the base element 24. The ribs 25 are substantially parallel to a third rib 26 located near a center axis 28 of the hanger device 5 and approximately equidistant from the two side ribs 25. Adhesive pile material 20 is attached on both sides of the ribs 25, 26 as well as, on both sides of the base element 24.

The adhesive pile material 20 sticks to and pulls apart easily from a similar adhesive pile material strip 21 on the inner surface 6 of the table skirt 7. Thus, the skirt 7 is wrapped around the hanger device 5, as illustrated in FIGS. 4 and 6, by wrapping the skirt 7 around the hanger device 5 by attaching one side 32 of the skirt's top edge to a lower corner 33 of the hanger 5, and continuing the wrapping on a diagonal plane relative to the center axis 14 of the hanger device 5. This method of wrapping increases the area of the table skirt 7 which is directly adhered to the adhesive pile material 20 of the hanger device 5. At the completion of the wrapping, the skirt 7 appears as shown in FIGS. 5, 7 and 9.

Once the skirt 7 is wrapped around the hanger device 5, it may be hung on a rod 34 which is attached to a moveable rack 36. In the preferred embodiment, as illustrated in FIGS. 1 and 9, the rack is an I-rack 36 having two vertical uprights 35, 37 attached to an I-shaped base. Further, the I-rack 36 is preferably mounted on castors 38 to easily move the rack assembly around as the table skirts 7 are being applied to the tables 8. It may be appreciated, however, that the castors 38 may be replaced with any moveable means known in the art, such as wheels, etc.

Figure 10:
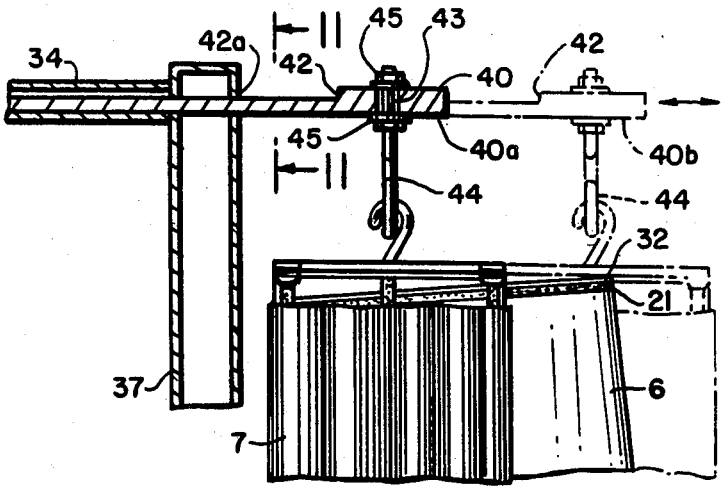
FIG. 10 is a cross sectional view taken along lines 10—10 of FIG. 9.
Figure 11:
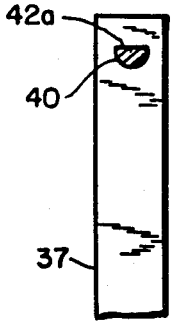
FIG. 11 is a cross sectional view taken along lines 11—11 of FIG. 10.

The rod 34 is hollow and accommodates an extension member 40 on its open end which telescopes into and out of the hollow rod 34 to extend its length. A stop 42 is provided on the extension member 40 on one side of the vertical upright 37 which has a stop 42*a* limiting the horizontal movement of the extension member 40 as is known in the art. The stop 42 may be placed at any length desired in the extension member 40 and is illustrated in FIGS. 9 and 10. FIG. 11 illustrates a cross section of the extension member 40 having stop 42*a*. When the extension member 40 is in an operating mode, it is moved from a telescoped position 40*a* to an extended position 40*b* as illustrated in phantom lines in FIGS. 9 and 10.

On one end of the extension member 40 is a smoothly bored opening 43 through which a swivel hook 44 is inserted in a manner so that the hook 44 hangs in a downward position toward the I-shaped base of the moveable rack 36 as illustrated in FIG. 10. The hook 44 is held in position by fasteners which in the preferred embodiment consist of a nut and bolt fastener 45 attached on both the top and bottom sides of the extension member 40.

To adhere the table skirt 7 to the perimeter 9 of the table 8, clip-on fasteners 46 which are well known in the art are used. The fasteners 46 may be of any length desired although shorter lengths of the fasteners 46 are most useful for curved areas such as round tables, whereas longer fasteners 47 are most useful on longer stretches of the table 8 such as on a rectangular table as shown in FIG. 1. The fastener 46 has an adhesive pile material 48 on a side away from the table's perimeter 9 substantially similar to the adhesive pile material 21 attached to the underside 6 of the table skirt 7. A cross section of the clip-on fastener 46 is illustrated in FIG. 8.

To utilize the inventive installment system 1 for attaching a table skirt 7 to a table 8, an installer wraps the table skirt 7 to be used around the hanger device 5. To wrap the skirt 7 around the device 5, one places the top underside corner 32 of the skirt on a lower corner, such as a lower left hand corner 33 of the hanger device, and wraps the skirt 7 across the entire side of the hanger device 5 in a diagonal direction upwardly toward the device's hook 5 until the entire surface of the adhesive pile material 20 of the device 5 is attached to the adhesive pile material 21 of the table skirt 7, as illustrated in FIGS. 4–5.

Subsequently, the installer clips on the fasteners 46 on the perimeter 9 of the table 8 to be skirted. As illustrated in FIG. 1, both short and long fasteners 46, 47 may be used as needed. Once the table is readied, the moveable rack 36 is pulled to an area close to the table 8 and the installer pulls the extension member 40 in a direction away from the rack 36 extending the space between the swivel hook 44 and the vertical poles 37 of the rack 36. This step allows a thicker or wider table skirt 7 to be accommodated in the space between the swivel hook 44 and the vertical pole 37 and promotes free turning of the skirt 7 as it is unwound from the hanger device 5.

The installer then moves a wrapped hanger device 5 from the rod 34 to the hook 44 and unwinds a free end 52 of the table skirt 7 from an upper corner 51 of the hanger device 5 as illustrated in FIGS. 1 and 9. The free end 52 of the table skirt 7 is then attached to a clip-on fastener 46 by pressing the adhesive pile material 21 on the underside 6 of the skirt 7 against the adhesive pile material 48 of the fastener 46. Traveling around the perimeter 9 of the table 8, the installer unwinds the skirt 7 as he moves and adheres the skirt to the fastener 6. Installment is facilitated by pushing the moveable rack 36 closer or further away from the table 8 as the position of the installer changes in his travels around the tables's perimeter. This procedure is repeated until the entire perimeter of the table 8 is covered by the number of table skirts 7 needed.

To reverse the procedure and remove the table skirt, one would take the top underside corner 32 of the table skirt 7, pull it away from the adhesive pile material 48 of a fastener 46, and attach it to the lower corner 33 of the hanger device 5 as discussed above and as illustrated in FIG. 4. Thus, easy installation, disassembling and subsequent storage of the table skirt 7 is accomplished by using the inventive installment system 1.

I claim:

1. An apparatus to install table skirts to a perimeter of a table, wherein said table skirts have adhesive pile materials attached to an inner surface of the skirts, and comprising:

(a) a fastener attached to said perimeter of said table and having an adhesive pile material on an outer surface facing away from said perimeter of said table;

(b) a movable rack having a rod supported by vertical supports and an extension member telescoping into and out of said rod, a swivel hook being supported on said extension member;

(c) a hanger having a hook on one end and a plurality of strips of adhesive pile material affixed to at least one surface of said hanger; and wherein said adhesive pile material attached to said inner surface of said skirts is removably attachable to said adhesive pile materials on said hanger so that said table skirts may be wound around said hanger so that said hanger would be supporting said table skirts in a storage position in which said hangers would be supported on said rod of said movable rack; and wherein said adhesive pile material on an inner surface of an end of said table skirts is removable from said adhesive pile material on said hanger and removably attachable to said adhesive pile material on said fastener attached to the perimeter of said table so that said table skirts can be unwound from said hanger when said hanger is in a work position suspended from said swivel hook on said extension member of said rod of said movable rack in order to wrap said table skirts around the perimeter of said table.

2. an apparatus according to claim further comprising a stop means milled in said extension member, located between said rack and said swivel hook and determining a length of said extension member as said extension member telescopes into and out of said rod.

3. An apparatus according to claim 1, wherein said hanger is molded of a thermoplastic material.

4. An apparatus according to claim 1, wherein said hanger comprises at least two plastic ribs attached to said hook of said hanger and arranged in a direction substantially parallel to a center axis of said hanger, said plastic ribs covered on at least one side with said strips of adhesive pile material.

5. An apparatus according to claim 1, wherein said strip of adhesive pile material of said hanger device is adhered to said hanger device in a direction substantially parallel to a center axis of said hanger device.

* * * * *